US005772024A

United States Patent [19]

Lueders

[11] Patent Number: 5,772,024

[45] Date of Patent: Jun. 30, 1998

[54] GOLF CLUB ORGANIZER

[76] Inventor: Robert C. Lueders, 11103 W. 115th Ter., Overland Park, Kans. 66210

[21] Appl. No.: 755,492

[22] Filed: Nov. 22, 1996

[51] Int. Cl.[6] ..... A63B 55/00

[52] U.S. Cl. ..... 206/315.6; 206/315.3

[58] Field of Search ..... 206/315.2–315.6

[56] References Cited

U.S. PATENT DOCUMENTS

| | | | |
|---|---|---|---|
| 1,092,729 | 4/1914 | Low et al. | 206/315.6 X |
| 1,442,906 | 1/1923 | Rawlings et al. | 206/315.6 X |
| 1,731,588 | 10/1929 | Patterson | 206/315.6 |
| 1,886,464 | 11/1932 | Bright | 150/160 |
| 1,951,492 | 3/1934 | Schneider | 206/315.2 |
| 2,471,169 | 5/1949 | Salzberg et al. . | |
| 2,595,987 | 5/1952 | Shears | 206/315.6 |
| 2,747,636 | 5/1956 | Couture . | |
| 2,867,257 | 1/1959 | Cart . | |
| 2,879,819 | 3/1959 | Turnbull | 206/315.4 |
| 2,938,559 | 5/1960 | Harkrader | 206/315.2 |
| 3,053,298 | 9/1962 | Stamp | 206/315.2 |
| 3,164,185 | 1/1965 | Ingoldt | 206/315.6 X |
| 3,460,597 | 8/1969 | Daly | 206/315.6 X |
| 3,554,255 | 1/1971 | Mangen | 206/315.6 |
| 3,931,842 | 1/1976 | White | 206/315.6 X |
| 3,967,667 | 7/1976 | Robinson | 206/315.6 |
| 4,194,547 | 3/1980 | Sidor et al. | 206/315.6 |
| 4,200,131 | 4/1980 | Chitwood et al. | 206/315.6 |
| 4,332,283 | 6/1982 | Rader | 206/315.6 |
| 4,497,404 | 2/1985 | Lowrance | 206/315.2 |
| 4,522,299 | 6/1985 | Clark et al. | 206/315.4 X |
| 4,838,416 | 6/1989 | Carman | 206/315.2 |
| 4,932,523 | 6/1990 | Yamozoe | 206/315.6 |
| 4,938,349 | 7/1990 | Burns | 206/315.6 |
| 5,088,600 | 2/1992 | Kopp, Jr. | 206/315.2 |
| 5,094,345 | 3/1992 | Yonnetti | 206/315.2 |
| 5,133,395 | 7/1992 | Moore | 150/160 |
| 5,255,781 | 10/1993 | Dulyea, Sr. | 206/315.6 |
| 5,275,278 | 1/1994 | Henry et al. | 206/315.6 |
| 5,458,240 | 10/1995 | Rich et al. | 206/315.3 |
| 5,465,839 | 11/1995 | Gretz | 206/315.3 |
| 5,522,592 | 6/1996 | Evelsizer, Jr. | 150/160 |
| 5,607,053 | 3/1997 | Sumiyoshi | 206/315.3 X |

FOREIGN PATENT DOCUMENTS

| | | | |
|---|---|---|---|
| 9216266 | 10/1992 | WIPO | 206/315.3 |

*Primary Examiner*—Sue A. Weaver

*Attorney, Agent, or Firm*—Litman, McMahon & Brown, LLC

[57] ABSTRACT

A golf club organizer includes a top plate and a bottom plate sized to form a top and bottom, respectively, of a golf bag. The top plate incorporates a plurality of through bores, each of which tapers inward from the top of the bore to a center portion thereof, and then tapers outward from the center portion of the bore to a bottom opening thereof. The bottom plate includes a plurality of upstanding pegs, each of which is shaped to receive the butt end of a respective golf club with each of the pegs including a drain opening in the center thereof. A plurality of flexible tubes, each with an inner diameter larger than the inner diameter of the thorough bores, are connected between respective ones of the through bores and the pegs. Golf clubs can be positioned, butt end down into each flexible tube via a respective upper plate through bore until they rest on a respective lower plate peg. The combination of this larger diameter tube, the tapered shape of the upper plate through bores and the flexible nature of the flexible tube allows a golf club to be placed into or withdrawn from one of the tubes at a substantial angle from the longitudinal axis of the tube.

13 Claims, 2 Drawing Sheets

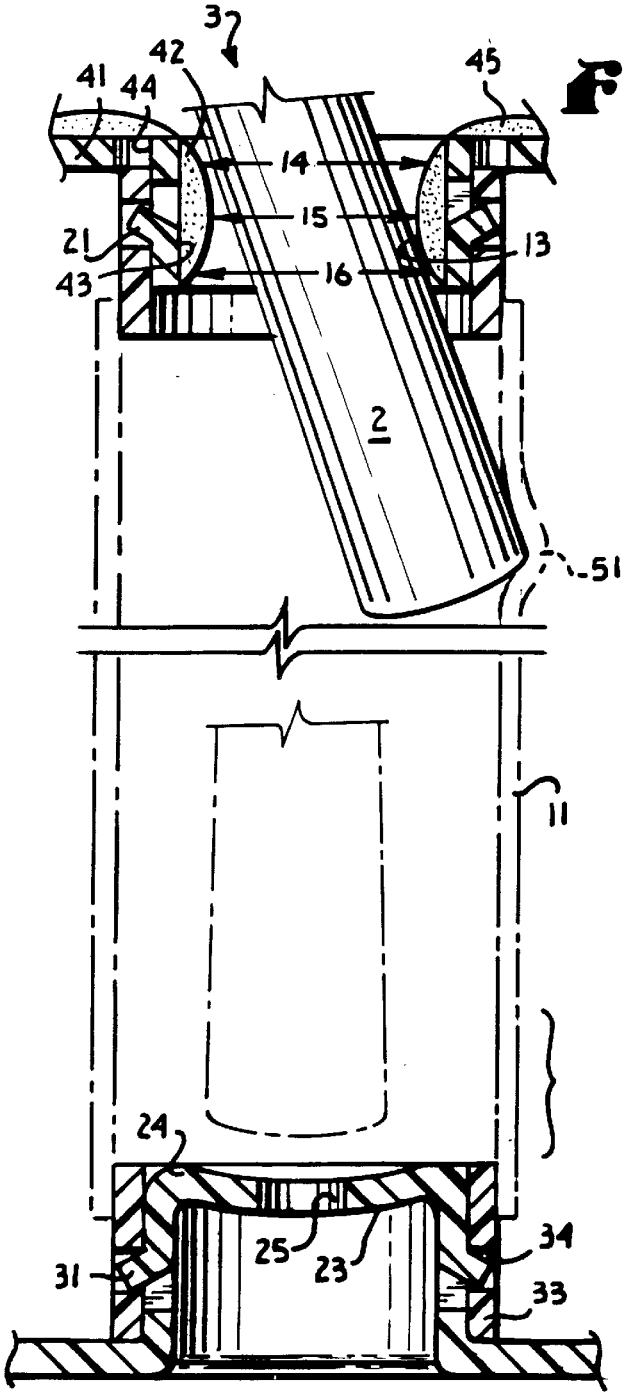
Fig.3.
Fig.4.
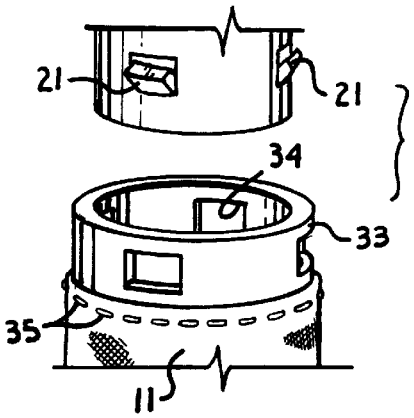
Fig.5.
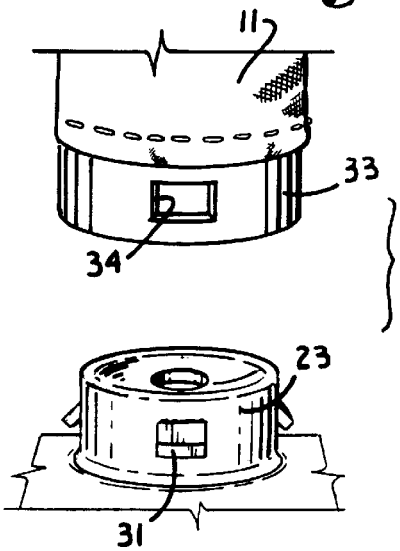

GOLF CLUB ORGANIZER

BACKGROUND OF THE INVENTION

1. Field of the Invention

The present invention relates generally to a golf club organizer, and, more particularly to such a golf club organizer with a plurality of flexible golf club shaft receiving tubes. Each flexible tube has a top opening which is connected to a respective venturi-like shaped through bore in a top plate and a bottom opening connected to a post formed on a bottom plate. The top and bottom plates are positioned in a golf bag such that the shaft of each golf club in the bag can be placed in a dedicated flexible tube via a respective through bore in the top plate and will rest on a respective post on the bottom plate.

2. Description of the Related Art

Typically, golfers carry a plurality of different clubs in a golf bag with the club shafts being received in the bag and the club heads protruding upward and out of the bag. Standard PGA tournament rules allow a maximum of fourteen clubs, including a putter. Typically, golf bags, and particularly popular light weight bags designed for carrying, are essentially an elongate hollow receptacle with an open top. Often dividers or ribs are placed across the open top to divide the opening into two or more areas. Golf clubs are placed, shaft end down into the bag with the dividers being used to separate the clubs at the bag top. A number of problems result from this type of bag. First, the club shafts are simply thrust into the bag in a disorganized fashion, with the club shafts and/or club heads often getting interlocked or entangled, thus making it difficult to insert, remove or locate a particular club. Furthermore, this entangling of clubs together in the bag often results in damage to the clubs, particularly to the grips and the heads. This presents a real problem to golfers, particularly with a set of golf clubs often ranging in cost from $500 to $1000 or more, and with clubs often equipped with graphite shafts which themselves are relatively easy to scar or damage.

A number of prior attempts have been made to address these problems. For example, somewhat typical of prior approaches is U.S. Pat. No. 3,554,255 to Joseph Mangan and entitled ADAPTER FOR GOLF BAG. In this patent, an adapter including an insert sized to fit in the top of the bag includes a number of apertures with each one sized to receive the butt end of a respective golf club. A number of rigid plastic tubes or passageways are placed in the bag with each tube being dropped through a respective aperture in the insert. Each tube then is positioned to receive a respective golf club, shaft end first, through an open mouth thereof such that the clubs are organized, protected and separated by the tubes. Although golf bags fitted with rigid plastic tubes have achieved some success, they suffer from a number of drawbacks. For one, the rigid plastic tubes tend to be somewhat heavy, particularly when fourteen of them are placed in a golf bag. Also, due to space limitations, typical plastic club receiving tubes tend to be of a diameter which snugly receives a golf club shaft and grip. Often golfers prefer grips which are somewhat oversized, particularly on certain clubs such as putters and wedges, which then may not fit in the tubes at all. Since the tube mouths and bodies are typically of a consistent diameter throughout their length, even clubs which fit in the tubes must be carefully placed into and withdrawn from these tubes in substantial alignment with the longitudinal axis of the tube to prevent the club shaft and grip from binding within the tube. This presents a problem when the golfer is in a hurry, or is in a position in which he or she is standing at an angle away from the golf bag. Another problem with substantially rigid tubes such as those in the Mangan patent is the tendency for moisture to collect in the tubes during rain or when the clubs are stored in the bag without use for an extended period.

It is clear, then, that an improved golf club organizer is needed. Such an organizer should organize and protect all golf clubs in a golf bag; should be light weight enough to be used with carry type bags, yet durable; should accommodate all clubs, even those with oversized grips; should permit clubs to be put into and withdrawn from the bag at a substantial angle in any direction; should be relatively simple and inexpensive to manufacture; and should be ventilated to allow moisture to escape from around stored golf clubs.

SUMMARY OF THE INVENTION

In the practice of the present invention, an improved golf club organizer includes a top plate sized to be received in a top opening of the golf bag. The top plate is formed with a plurality of through bores, each of which tapers inward from a top opening of the bore to a center portion thereof, and then tapers outward from the center portion of the bore to a bottom opening thereof. Spaced about the periphery of each through bore are a plurality of tabs which extend outward from the bore periphery. The organizer also includes a bottom plate with a plurality of upstanding pegs, each of which is shaped to receive the butt end of a respective golf club. Each of the pegs includes a drain opening in the center thereof and also includes a plurality of tabs which are spaced about the periphery of the peg and extend outward therefrom. In a preferred embodiment, the top and bottom plates also form integral top and bottom portions of the golf bag itself. A plurality of flexible tubes open at either end are each attached to respective upper and lower collars by sewn seams or similar attachment methods. Each of the upper and lower collars, which can be identical, includes a series of cutouts which mate with respective ones of the tabs on either of the through bores in the upper plate or the pegs in the lower plate. Each flexible tube is thus secured at one end to a respective bore in the upper plate via a first one of the collars, and is secured at the other end of the flexible tube to a respective one of the pegs in the bottom plate via a second one of the collars. Each flexible tube thus extends from an upper plate bore to a lower plate peg such that a golf club can be positioned, butt end down, into each flexible tube via the upper plate bore until it rests on the respective lower plate peg. The internal diameter of each flexible tube is preferably somewhat larger than the diameter of the respective through bore in the upper plate. The combination of the larger diameter tube, the tapered "venturi-like" shape of the upper plate bores and the flexible nature of the flexible tubes allows a golf club to be placed into or withdrawn from one of the tubes at a substantial angle from the longitudinal axis of the tube. The upper plate can be formed by molding a base plate with cylindrical apertures and tabs formed thereon. The base plate is then overmolded with a layer of resilient material which forms around the apertures to yield the tapered through bores.

OBJECTS AND ADVANTAGES OF THE PRESENT INVENTION

The objects and advantages of the present invention include: providing an improved golf club organizer; providing such an organizer for a golf bag which includes a plurality of flexible tubes for receiving respective golf club shafts and grips; providing such an organizer which includes an upper plate with a plurality of through bores extending therethrough, with each through bore mating with a respective one of the flexible tubes such that golf club shafts can be pushed through a through bore and into the respective flexible tube; providing such an organizer with a bottom plate with a plurality of upstanding posts positioned thereon with each post including a drain hole and being connectable with a second end of a respective one of the flexible tubes such that the butt of a golf club shaft placed into the flexible tube through the upper plate comes to rest on the respective post on the lower plate; providing such an organizer in which each flexible tube is attached at upper and lower open ends to respective collars with each collar including cutouts which are sized and positioned to mate with tabs provided in either the upper plate through bores or the lower plate posts to securely and non-rotatably connect the flexible tube between a respective through bore and a respective post; providing such an organizer in which the internal diameter of each flexible tube is larger than the internal diameter of the respective through bore and in which each through bore is tapered in a venturi-like shape such that golf clubs can be placed into the organizer from a substantial angle away from the longitudinal axis of each of the flexible tubes; and to provide such an organizer which is economical to manufacture, which is efficient and convenient in operation, capable of a long operating life and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is a greatly enlarged, cross-sectional view of a single flexible golf club receiving tube, showing in detail the connection of the flexible tube to a respective through bore in the top plate and a respective post in the bottom plate, and illustrating a golf club shaft in solid lines being placed into the flexible tube at a substantial angle, and, in phantom lines, resting near the bottom plate post.

FIG. 4 is a greatly enlarged, fragmentary, perspective view of a top portion of a flexible tube attached to a collar with the collar positioned beneath a bottom portion of a top plate through bore, with cutouts in the collar in a position to be snapped over corresponding tabs on the through bore.

FIG. 5 is a greatly enlarged, fragmentary, perspective view of a bottom portion of a flexible tube attached to a collar with the collar positioned above a top portion of a bottom plate peg, with cutouts in the collar in a position to be snapped over corresponding tabs on the peg.

DETAILED DESCRIPTION OF THE PREFERRED EMBODIMENTS

Figure 1:
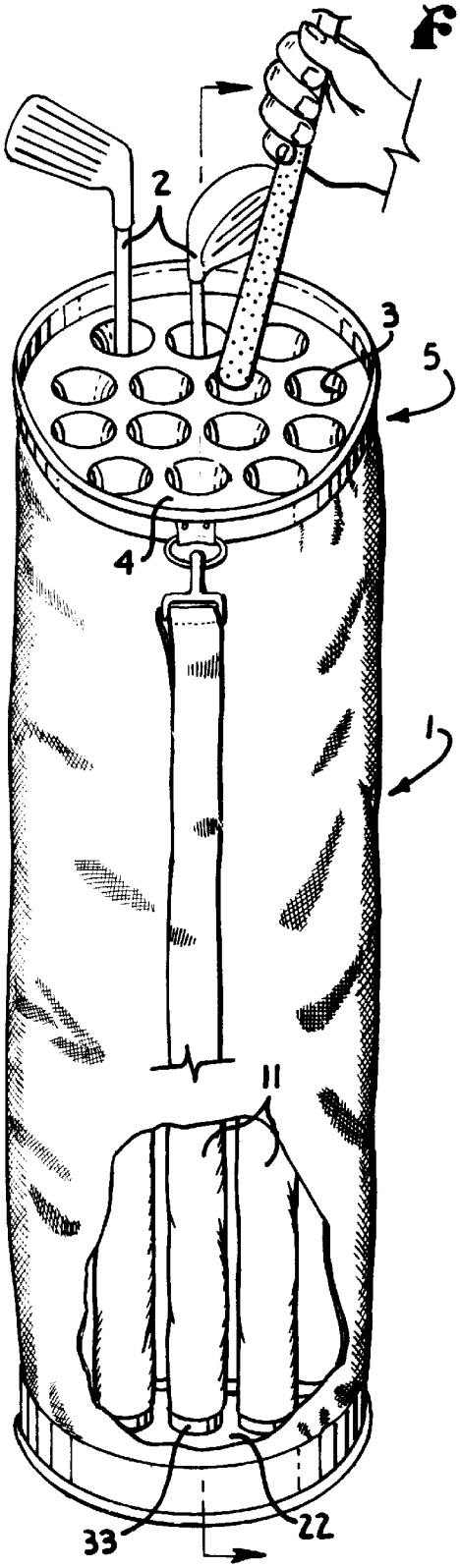
FIG. 1, is a perspective view of a golf bag equipped with a golf club organizer in accordance with the present invention, with a portion of the golf bag broken away to illustrate flexible tubes contained therein, and with a golf club shown being inserted therein.

As required, detailed embodiments of the present invention are disclosed herein; however, it is to be understood that the disclosed embodiments are merely exemplary of the invention, which may be embodied in various forms. Therefore, specific structural and functions details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience and reference only and will not be limiting. For example, the words "up", "down", "right" and "left" will refer to directions in the drawings to which reference is made. The words "in" and "out" will refer to directions toward and away from, respectively, the geometric center of the structure being referred to. Said terminology will include the words specifically mentioned derivatives thereof and words of similar import.

Referring to FIG. 1, a golf bag 1 is shown with a plurality of golf clubs 2 inserted into corresponding through bores 3 in a top plate 4 of a golf organizer in accordance with the present invention, generally indicated at 5. Each golf club 2 is inserted into a respective flexible tube 11 through a respective through bore 3 in the top plate 4, in a manner to be described below.

Figure 2:
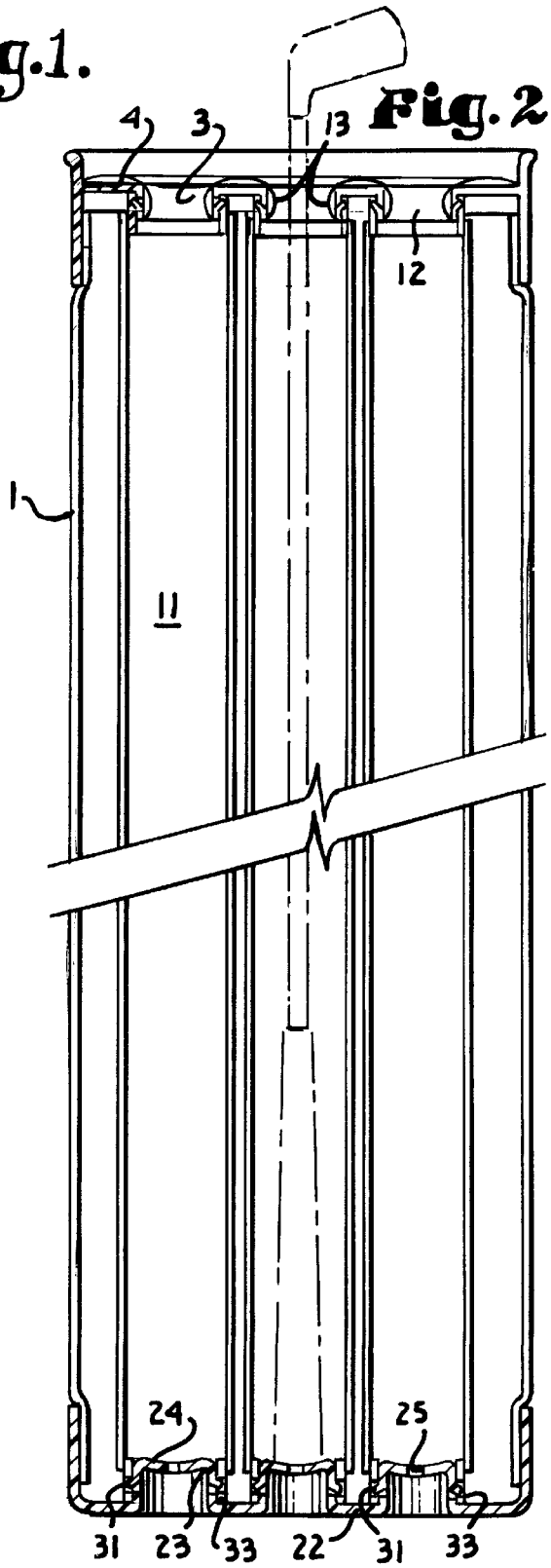
FIG. 2 is a slightly enlarged, cross-sectional view of the golf bag, taken along line 2—2 of FIG. 1, with the center portion broken away, and illustrating the overall construction of the golf club organizer.

Referring to FIGS. 2 and 3, the golf club organizer 5 includes the top plate 4 with the through bores 3 extending therethrough. In a typical golf bag 1, there would preferably be fourteen such through bores 3, which is a number equal to the maximum number of clubs allowed in a tournament by PGA rules. Each through bore 3 is formed by an opening 12 within which is formed a "venturi-like" shape 13 which is preferably formed from a resilient material such as a synthetic rubber, vinyl or fabric covered foam. The taper 13 thus starts at an initial diameter 14 at the top of the top plate 4, tapers inward to a minimum diameter approximately in a center 15 of the through bore 3, and then tapers back outward again to a larger diameter 16 at the bottom of the through bore 3. Equally spaced about the outside periphery of each through bore 3 are a plurality of spring tabs 21, here shown as four in number, which can be formed during molding of the top plate 4 in a known manner.

The organizer 5 also includes a bottom plate 22 which can also be molded from plastic as a single piece. The bottom plate 22 includes a plurality of upstanding posts 23, which are equal in number and are located in corresponding positions to the through bores 3 in the top plate 4. Each post 23 has an upper surface 24 with a concave shape designed to accommodate the, typically, convex shaped butt end of a golf club 2. Positioned on the center of each post upper surface 24 is a drain and ventilation hole 25 which allows moisture to drain off of each post 23. Each post 23 is molded with a plurality of spring tabs 31 spaced equally about the periphery thereof in matching positions to the tabs 21 about the through bores 3 in the top plate 4.

The organizer 5 further includes a plurality of the flexible tubes 11, each of which can be fabricated by sewing a flexible fabric into a cylindrical or conical configuration. A pair of collars 33 are attached to respective upper and lower ends of each tube 11. Each collar 33 includes a plurality of cutouts 34 extending outward from the outside periphery thereof in locations which match the locations of the tabs 21 and 31 in the upper and lower plates 4 and 22, respectively. Each collar 33 has an inside diameter which is slightly larger than the outside diameter of the through bores 3 and the posts 23. Each flexible tube 11 is thus attachable between a through bore 3 in the upper plate 4 and a corresponding post 23 in the bottom plate 22 by simply snapping the respective collars 33 over the through bore 3 and the post 23 and snapping the cutouts 34 over the respective tabs 21 and 31. Furthermore, the use of a plurality of tabs 21 and 31 spaced about the periphery of the through bores 3 and the posts 23, respectively, when the collars 33 are snapped in place thereover, assures that the flexible tubes 11 cannot rotate relative to the through bores 3 and the posts 23. This prevents the flexible tubes 11 from twisting, which can restrict the tube diameter and prevent clubs 2 from being fully inserted or easily withdrawn. An inside periphery of each end of each flexible tube 11 is preferably sewn via seams 35 or otherwise attached to the outside periphery of a respective one of the collars 33, thus each flexible tube 11 has an inside diameter which is larger than the inside diameter of the respective through bore 3. It should be noted that one or more of the tabs 21 and 31 can be sized or shaped differently than the rest, with corresponding ones of the cutouts 34 similarly shaped so as to act as keys to insure that the flexible tubes 11 are not inadvertently twisted during installation.

One method of manufacturing the top plate 2 with the through bores 3 is to mold a base plate 41, as shown in FIG. 2 with openings 42 with vertical sides 43. The tabs 21 can be created in this initial base plate molding process by tools (not shown) inserted through slots 44 in the top surface of the base plate 41. The base plate 41 is then overmolded with a resilient material layer 45 of synthetic rubber or the like, which layer 45 forms the venturi-like shapes 13 and also serves to cover the slots 44 in the base plate 41. If a similar molding technique were used to create the bottom plate 22, then tooling slots similar to the slots 44 in the top base plate 41 would also be required, although they have not been illustrated herein.

FIG. 3 illustrates the shaft of a golf club 2 (in solid lines) being inserted into the flexible tube 11 via a through bore 3. Due to the venturi-like shape 13 of the through bore 3, the larger inside diameter of the flexible tube 11, as well as the flexible nature of the tube 11, as illustrated by the bulging area 51, the club 2 can be inserted into the tube 11 from a substantial angle away from the longitudinal axis of the flexible tube 11. Furthermore, the resilient material 45 forming the venturi-like shape 13, and the flexible nature of the tubes 11 protects the shaft of the club 2 as it is inserted and removed from the tube 11.

It should be noted that, although the flexible tubes 11 have been described as being constructed of sewn material, other manufacturing techniques can be used, such as a seamless extrusion, for example. The venturi-like shapes 13 of the through bores 3 have been described as including a resilient covering 45 over a molded plastic base plate 41, but it is conceivable that the base plate 41, including the tapered venturi-like shapes 13, can be molded as an integral part. The particular shape of the posts 23 is also exemplary only, and other shapes can be employed as well or the posts 23 can be simply eliminated and the flexible tubes 11 attached directly to a flat bottom plate, preferably equipped with drain holes. The disclosed method of attaching the flexible tubes 11 to the through bores 3 and the posts 23 via tabs 21 and 31 and interlocking collars 33 is also merely exemplary. There are many other methods of attachment which could be employed, including sewing the tubes directly to the through bores 3 and the posts 23, using a cinch tie to attach the tubes 11 around the through bores 3 and the posts 23, using screws and grommets, brads or rivets, etc. While the top plate 2 and the bottom plate 22 are illustrated as integral components of the bag 1, it is contemplated that the inventive golf club organizer 5 including top and bottom plates 4 and 22, respectively and the flexible tubes 11, could be marketed as an add-on system to be placed into existing golf bags. The provision of fourteen of the flexible tubes 11 is also a number which can be varied up or down depending upon the needs of a particular golfer or manufacturer.

It is thus to be understood that while certain forms of the present invention have been illustrated and described herein, it is not to be limited to the specific forms or arrangement of parts described and shown.

I claim:

1. A golf club organizer comprising:

a) a top plate with a plurality of through bores extending therethrough, each said through bore being of a diameter sufficient to accept a shaft and grip of a golf club therein, each said through bore being formed by a respective aperture in said top plate and a generally cylindrical wall which forms a sleeve extending downward from a top surface of said top plate, each said sleeve including an inner diameter and an outer diameter greater than said inner diameter, each said through bore including an open top portion commencing at a toy surface of said top plate, an open bottom portion terminating at a bottom of said sleeve and a middle portion between said top portion and said bottom portion, said inner diameter of each said through bore tapering inward from said top portion to said middle portion such that said inner diameter decreases from said top portion to said middle portion, and also tapering outward from said middle portion such that said inner diameter increases from said middle portion to said bottom portion;

b) a bottom plate; and c) a plurality of flexible tubes, each of which is connected at a first open end to a respective one of said through bore sleeves and at a second open end to said bottom plate, each said flexible tube having an internal diameter which is greater than the largest internal diameter of the respective through bore sleeve, the combination of said inward and outward taper of said through bore sleeves and the flexible nature and the diameter of said tubes allowing a large angle of entry and exit, respectively, for golf club shafts and grins relative to said sleeves as the shafts are put into and taken out of said flexible tubes.

2. A golf club organizer as in claim 1, wherein:

a) said bottom plate includes a plurality of upstanding posts equal in number to said plurality of through bores and each said flexible tube second end is connected to a respective said upstanding post.

3. A golf club organizer as in claim 2, and further comprising:

a) a plurality of collars, each of said flexible tubes having a respective one of said collars attached about each of its first and second open ends, each of said posts and through bore sleeves including a plurality of tabs attached to and radially arrayed around the respective post or through bore sleeve, said tabs being sized and configured to grasp and retain a respective one of said collars as it is placed over the respective post or through bore sleeve.

4. A golf club organizer as in claim 1, wherein:

a) each of said upstanding posts has a drain opening therein.

5. A golf club organizer as in claim 1, wherein said inward and outward tapers of said top plate through bore sleeves are formed of a resilient material.

6. A golf club organizer as in claim 5, wherein said top plate includes:

a) a molded base plate with said plurality of apertures and said sleeves formed therein; and b) said resilient material is overmolded over said base plate apertures and sleeves to form said inward and outward tapers of said top plate through bore sleeves.

7. A golf club organizer comprising:

a) a top plate with a plurality of through bores extending therethrough, each said through bore having an inner diameter sufficient to accept a shaft and grip of a golf club therein, each said through bore being formed by a respective aperture in said top plate and a generally cylindrical wall which forms a sleeve extending downward from a top surface of said top plate, each said through bore including an open top portion commencing at a top surface of said top plate, an open bottom portion terminating at a bottom of said sleeve and a middle portion between said top portion and said bottom portion, said inner diameter of each said through bore tapering inward from said top portion to said middle portion such that said inner diameter decreases from said top portion to said middle portion, and also tapering outward from said middle portion such that said inner diameter increases from said middle portion to said bottom portion;

b) a bottom plate including a like plurality of upstanding posts; and c) a plurality of flexible tubes with each said tube being connected at a first open end to a respective one of said through bore sleeves and at a second open end to a respective one of said posts, the combination of said inward and outward taper of said through bore sleeves and the flexible nature of said tubes allowing a large angle of entry and exit, respectively, for golf club shafts and grips relative to said sleeves as the shafts are put into and taken out of said flexible tubes.

8. A golf club organizer as in claim 7, wherein:

a) each of said upstanding posts has a drain opening therein.

9. A golf club organizer as in claim 7, wherein each said flexible tube has an internal diameter which is greater than the largest internal diameter of the respective through bore sleeve.

10. A golf club organizer as in claim 9, wherein said inward and outward tapers of each said through bore are formed of a resilient material.

11. A golf club organizer as in claim 10, wherein said top plate includes:

a) a molded base plate with said plurality of apertures formed therein; and b) said resilient material is overmolded over said base plate to form said inward and outward tapers.

12. A golf club organizer as in claim 7, and further comprising:

a) a plurality of collars, each of said flexible tubes having a respective one of said collars attached about each of its first and second open ends, each of said posts and through bore sleeves including a plurality of tabs attached to and radially arrayed around the respective post or through bore sleeve, said tabs being sized and configured to grasp and retain a respective one of said collars as it is placed over the respective post or through bore sleeve.

13. A golf club organizer comprising:

a) a top plate with a plurality of through bores extending therethrough, each said through bore being of a diameter sufficient to accept a shaft and grip of a golf club therein;

b) a bottom plate including a like plurality of upstanding posts;

c) a plurality of flexible tubes with each said tube having a first open end and a second open end; and d) a plurality of collars, each of said flexible tubes having a respective one of said collars attached about its first and second open ends, each of said posts and through bore including a plurality of tabs attached to and radially arrayed around the respective post or through bore, said tabs being sized and configured to grasp and retain a respective one of said collars as it is placed over the respective post or through bore.

* * * * *